US006811384B2

(12) United States Patent
Virgilio

(10) Patent No.: US 6,811,384 B2
(45) Date of Patent: Nov. 2, 2004

(54) AUTOMATIC REGULATOR OF INTAKE AIR IN A TANK

(76) Inventor: Mietto Virgilio, Via Como, 17, 36051, Olmo di Creazzo (Vicenza) (IT)

( * ) Notice: Subject to any disclaimer, the term of this patent is extended or adjusted under 35 U.S.C. 154(b) by 270 days.

(21) Appl. No.: 10/160,597

(22) Filed: May 31, 2002

(65) Prior Publication Data

US 2003/0223888 A1 Dec. 4, 2003

(51) Int. Cl.[7] ..... F04B 49/00; F16K 31/12
(52) U.S. Cl. ..... 417/295; 417/298; 418/201.2
(58) Field of Search ..... 417/295, 298, 417/313; 251/30.02, 30.05; 418/201.2

(56) References Cited

U.S. PATENT DOCUMENTS 5,411,375 A * 5/1995 Bauer ..... 417/295
5,533,873 A * 7/1996 Kindl ..... 417/295
6,123,510 A * 9/2000 Greer et al. ..... 417/53
6,146,100 A * 11/2000 Broucke ..... 417/28
6,715,998 B2 * 4/2004 Virgilio ..... 417/295

* cited by examiner

*Primary Examiner*—Charles G. Freay
(74) *Attorney, Agent, or Firm*—Bucknam and Archer

(57) ABSTRACT

An automatic regulator of the air intake in a tank installed in a circuit for the production of compressed air wherein the regulator provides that the intake orifice (7) which aspires external air is operated in opening/closing by means of a disk shutter. The disk shutter is provided with a tang which idly slides on a central hub. The disk shutter is subjected to the biasing action of a spring which sits in the hub and to the balancing action of a flux of air removed from the separator tank.

7 Claims, 3 Drawing Sheets

AUTOMATIC REGULATOR OF INTAKE AIR IN A TANK

FIELD OF THE INVENTION

The present invention relates to an automatic regulator of intake air in a tank and, more specifically, it relates to such a regulator of the type normally used for feeding a distribution plant with compressed air.

BACKGROUND OF THE PRIOR ART

In industrial applications, installations for the production of compressed air are well known. Such installations are constituted essentially by an oil bath spin compressor, an air/oil separator tank, a tank for the accumulation of pressurized air and a minimum pressure valve. The minimum pressure valve is inserted in the conduit between the separator tank and the accumulation tank and other valves (thermostatic, pressurestats or safety).

In particular, normally on top of the installation, there is present a valve which has the function of intercepting the passage of air from the exterior to the interior of the circuit. This valve is normally called an intake regulator and a particular constructive form is disclosed in Italian patents Nos. 85521/A/90, No. 1270553 and No. 1270769 filed in the name of the applicant herein. The valve is applied at the orifice of the spin compressor intake and has the function of regulating or interrupting the flow of intake air from the exterior as a function of the requirements of the operation of the installation.

The intake regulator is constituted essentially by a slider which is provided with an alternating rectilinear motion, caused by the balancing effect between the pressure generated by the aspired exterior air and the pressure contrary to the preceeding one generated by the pressurized air from the circuit.

In the present state of the art, the operation of the intake regulator is only possible using sufficiently complex circuits which use mechanical parts put in motion by means of springs and to ensure tightness with gaskets and worked seats, all matters requiring a complex construction and high cost of the regulator.

In addition, normally, when in the pressurized air accumulation tank the desired pressure is reached, the air which is produced by the compressor which continues to function at idle is directly discharged to the atmosphere with the consequent effects of pollution.

SUMMARY OF THE INVENTION

An object of the present invention is to provide an automatic external air intake regulator with which it is possible to reduce energy consumption and pollution, whereby it is possible in operating at idle to reach in the separator tank a minimum pressure and possible to use again almost totally the pressurized air which is not stored in the accumulation tank.

A further object of the invention is to provide an automatic external air intake regulator which is of substantially simplified construction because it is constituted by a monobloc in the interior of which there are only two conduits, the monobloc being without seals and elastic devices, such as springs, because the slider is advantageously supported by an air cushion.

Still another object of this invention is to provide an automatic external air intake regulator which requires for its regulation only one electrovalve.

Still another object of this invention is to provide an automatic external air intake regulator in which it is possible to generate a counterpressure capable of balancing the negative pressure which is generated on the mechanism of the screw pump during idling.

BRIEF DESCRIPTION OF THE DRAWINGS

These and other characteristics of the invention are described hereinbelow by reference to the attached drawings which illustrate a possible embodiment provided as an illustrative non-limiting example in which:

FIG. 4 shows the regulator of FIG. 2 during functioning at full load; and.

DETAILED DESCRIPTION OF THE INVENTION

Figure 1:
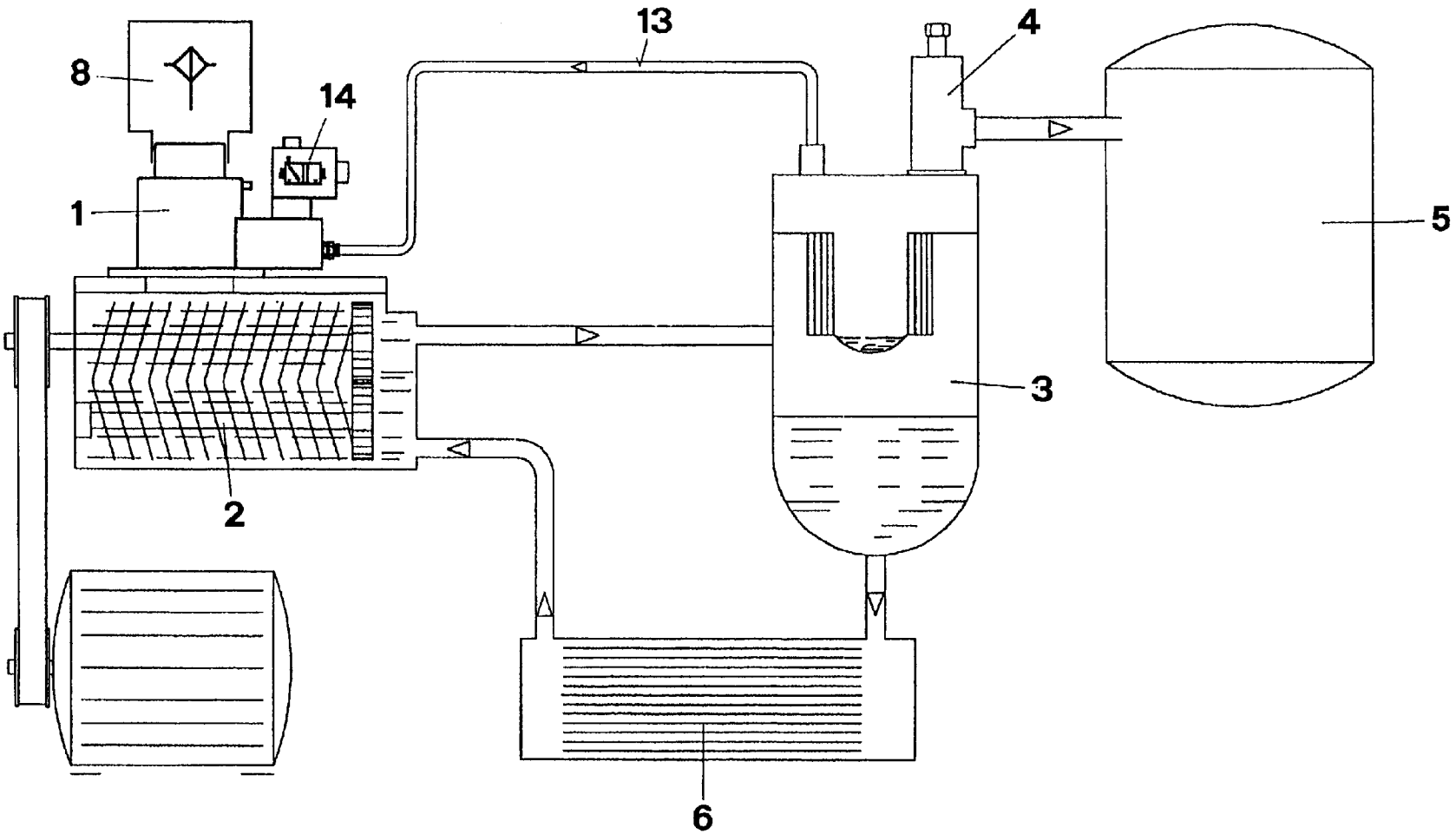
FIG. 1 shows a general scheme of an installation for the production of compressed air by means of an oil bath spin compressor, provided with the automatic regulator of the invention.

As shown in FIG. 1, the installation for the production of compressed air is constituted essentially by the intake regulator (1) which intercepts external air and directs the air to the oil bath spin compressor (2), the compressor being actuated by an electric motor.

The oil/air mixture of pressurized fluid produced by the compressor passes into the separator tank (3) where separation of the air from the oil occurs. The pressurized air, regulated by a minimum pressure valve (4) goes to fill accumulation tank (5), waiting to be used while the oil returns to compressor (2) in a circle by means of radiator (6).

Figure 2:
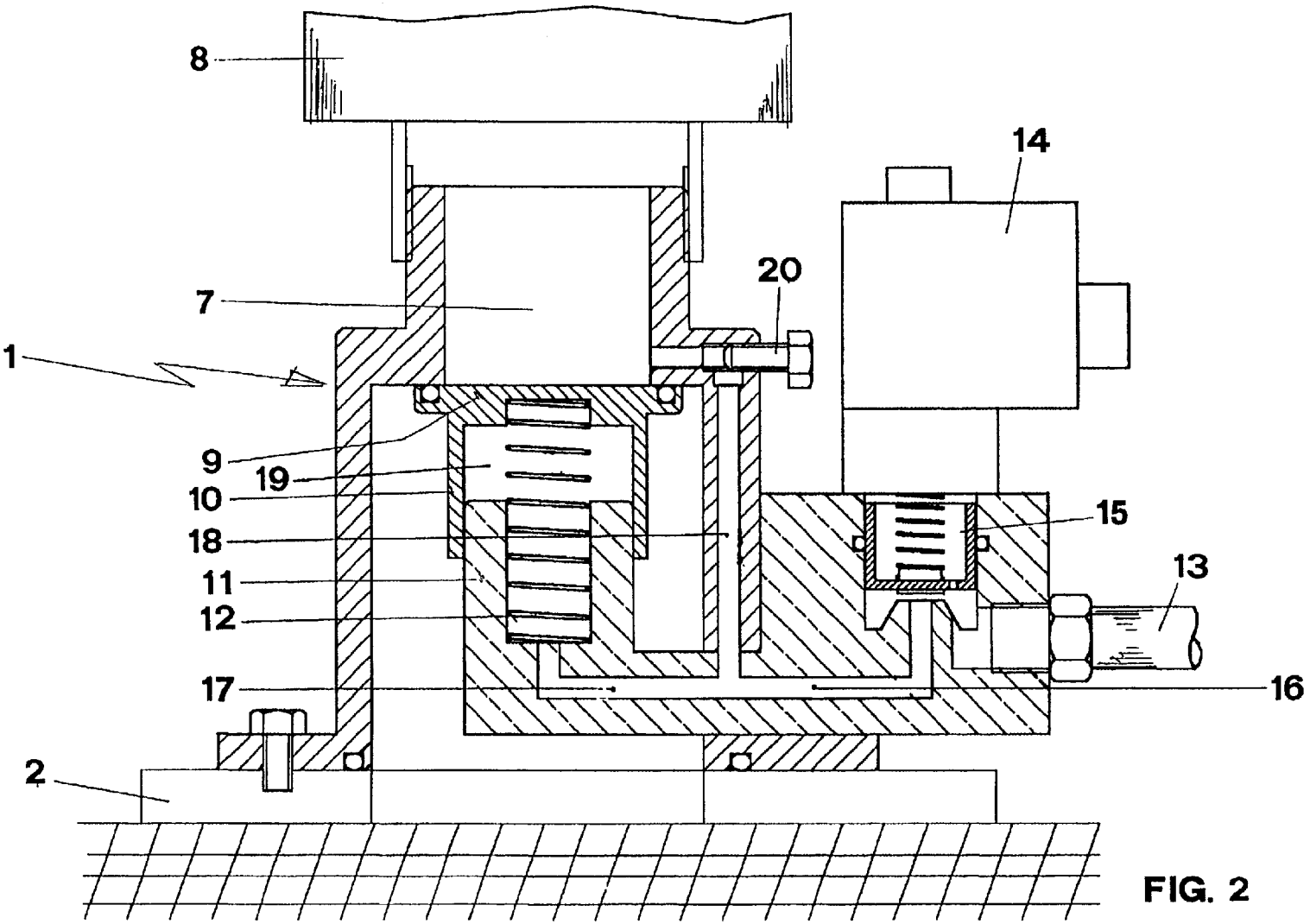
FIG. 2 shows an elevational cross-sectional view of the regulator of the invention, in a non-operative condition.

As shown in FIG. 2, the intake regulator (1) of this invention inhales external air by means of the intake orifice (7) which is provided with filter (8) and which in opening/closure is operated by means of disk shutter (9) which is provided with tang (10). Tang (10) slides idly on the central hub (11). The shutter disk (9) is subjected to the biasing action of spring (12) which sits in the hub (11).

The intake regulator (1) in addition is fed by a flux of air under pressure removed from the separator tank (3) by means of external tubing (13). This flux of air is intercepted by electrovalve (14) which is applied on the body of the regulator. This valve by means of piston shutter (15) directs the passage of the flux of the air in conduit (16) formed in the body of the regulator.

Conduit (16) is divided into two conduits (17) and (18). Conduit (17) directs a part of the flux of air under pressure into the chamber (19) which has variable volume. This chamber functions as a pad or bearing for the disk shutter (9) while conduit (18) directs the other part of the flux of air to the exterior in the intake orifice (7) so that it may return again in a circle, the course of this second flux being regulated by means of the adjusting screw (20).

As shown in FIG. 2, during the stopping of the installation the intake orifice (7) is closed by the disk shutter (9) which is kept beating by the spring (12) so that the oil is prevented from leaving the compressor in case the latter does not function well or there is a rupture of the transmission belt.

Figure 3:
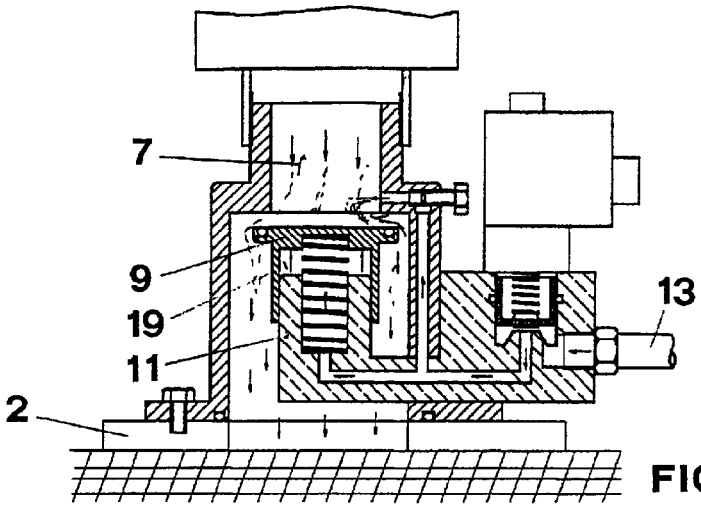
FIG. 3 shows the regulator of FIG. 2 during start-up condition of the installation.

In actual operation, the first characteristic of novelty of the regulator of the invention becomes evident in the starting phase of the installation when the opening of the intake orifice occurs in a progressive manner. In fact, as shown in FIG. 3, the lowering of the disk shutter (9) following the depression generated in the chamber of spin compressor (12), does not occur in a rapid manner but which is progressive because it is opposed by the air cushion under pressure which occupies chamber (19) underneath, fed by conduit (17) and the opening of the piston shutter (15) of the electrovalve (14) which is de-energized.

Figure 4:
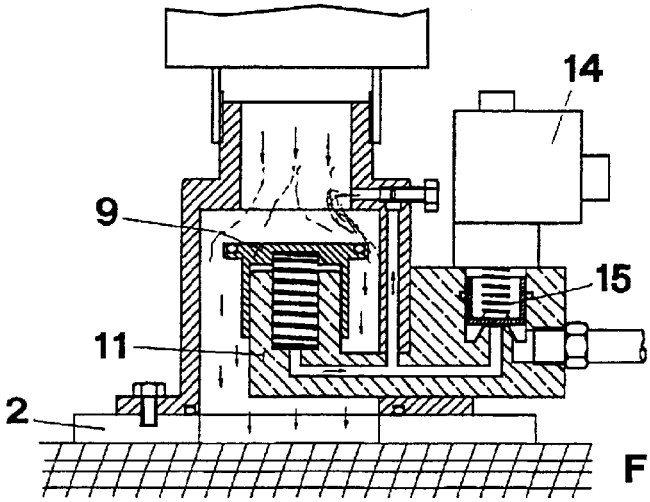

Again in operation, as shown in FIG. 4, in the functioning at full load the electrovalve (14) is energized and by means of piston shutter (15) closes conduit (16) and the air cushion in chamber (19) is annulled thus allowing the disk shutter (9) subjected to the force of depression generated by the spin compressor to perform the maximum course of opening.

Figure 5:
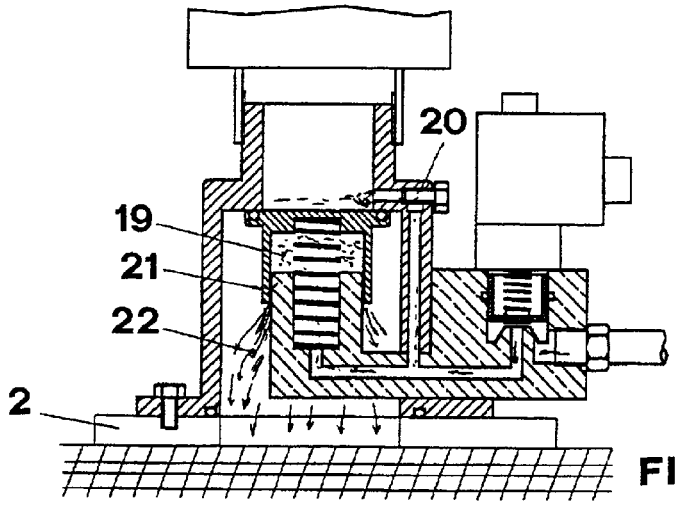
FIG. 5 shows the regulator of FIG. 2 during functioning without load or at idle.

A further characteristic of novelty of the pressure regulator of this invention resides in the functioning at idle in which a flux of air balances the negative push of the depression in the spin compressor. In fact as shown in FIG. 5, during the functioning at idle, the pressurized air which is not sent to the accumulation tank (5), reenters chamber (19) through conduits (16) and (17) where it provides to push and keep in position of closure the disk shutter (9), while the value of the pressure of this flux of air of reentry is regulated by narrowing the discharge conduit (18) by means of the adjusting of adjusting screw (20). Specifically the greater the narrowing the smaller is the pressure in chamber (19) normally 2–2.5 bar.

Finally, advantageously, part of the pressurized air contained in chamber (19) exits from the sliding space (21) between tang (10) and hub (11) thus forming the flux of air (22) which is aspired by the pump during operation.

On the basis of the foregoing, the advantages both constructive and in functioning of the intake regulator of the invention are evident in which the only moving part is constituted by the disk shutter (9) which has a very simplified shape and which is set in motion by means of a cushion of air and the regulation is determined only by the electrovalve (14).

What is claimed is:

1. An automatic regulator for the air intake in a tank installed in a circuit for the production of compressed air, said circuit includes an intake regulator (1) which intercepts external air and directs the air to an oil bath spin compressor (2), the oil/air mixture of pressurized fluid produced by the compressor entering a separator tank (3) wherein the separation of air from oil occurs, the pressurized air regulated by a minimum pressure valve (4) going to fill an accumulation tank (5) waiting to be used while the oil returns through a radiator (6) in a circle to said compressor, said intake regulator (1) comprising an intake orifice (7) which aspires external air through a filter (8) which is opened/closed by means of a disk shutter (9), said disk shutter being provided with a tang (10) which slides idly on a cental hub (11), said disk shutter being subjected to the biasing action of a spring (12) which sits in said hub and to the balancing action of a flux of pressurized air removed from said separator tank (3).

2. The regulator according to claim 1, wherein the flux of pressurized air which balances the motion of said disk shutter (9) is removed from the separator tank (3) by means of external tubing and is intercepted by an electovalve (14), said electrovalve being applied on the body of said regulator, said electrovalve by means of a piston shutter (15) directing the passage of the flux air in a first conduit (16) formed in the body of the regulator.

3. The regulator according to claim 2, wherein said first conduit (16) is divided into a second conduit (17) and a third conduit (18), said second conduit (17) conveying a part of the flux of air under pressure into a chamber (19) of variable volume whereby said flux of air in said chamber (19) functions as a cushion for the disk shutter (9), said third conduit (18) conveying a second part of the flux of air to the exterior in said intake orifice (7) whereby the second part of the flux of air may return in circle, the course of said second part of the flux of air being regulated by means of an adjustment screw (20).

4. The regulator according to claim 3, wherein said disk shutter (9) is lowered to open the intake orifice in a progressive manner because its motion towards the interior following the depression generated in the chamber (19) by the stopping of the spin compressor is opposed by the cushion of pressurized air which occupies the chamber underneath, said chamber being fed by said second conduit (17) and prior opening of the piston shutter (15) of said electrovalve (14) which has been de-energized.

5. The regulator according to claim 3, wherein during functioning of the spin compressor at full load the electrovalve (14) is energized and by means of the piston shutter (15) closes said first conduit (16) and the cushion of air in the chamber (19) is annulled, thereby allowing the disk shutter (9) subjected to the depression force generated by the spin compressor to carry out the maximum course of aperture.

6. The regulator according to claim 3, wherein durin ghte functioning at idle of the spin compressor a flux of air under pressure is generated which balances the negative push of the depression in the spin compressor, said flux being constituted by the air under pressure which is not sent to the accumulation tank (5) but reenters through said first (16) and second (17) conduits into said chamber (19) where it biases said disk shutter (9) to the closed position, a part of said air under pressure exiting from a space of sliding (21) between said tang (10) and said hub (11) to form a flux of air (22) aspired by the spin compressor during functioning.

7. The regulator according to claim 6, wherein the pressure in said chamber (19) is determined by regulating the extent of passage of said second conduit (17) by means of adjusting of said adjustment screw (20).

* * * * *